United States Patent [19]

Schapansky

[11] Patent Number: 4,645,181

[45] Date of Patent: Feb. 24, 1987

[54] HIGH PERFORMANCE AIR JACK

[76] Inventor: Lloyd D. Schapansky, P.O. Box 129, Cornelia, Ga. 30531

[21] Appl. No.: 782,021

[22] Filed: Sep. 30, 1985

[51] Int. Cl.[4] ..... B66F 3/00

[52] U.S. Cl. ..... 254/2 B

[58] Field of Search ..... 254/2 B, 8 B, 9 B, 10 B, 254/133, 134, 423, DIG. 2, DIG. 4, DIG. 1

[56] References Cited

U.S. PATENT DOCUMENTS

| | | | |
|---|---|---|---|
| 2,530,138 | 11/1950 | Wallace | 254/2 R |
| 2,868,501 | 1/1959 | Cloud et al. | 254/2 B |
| 3,350,063 | 10/1967 | Thurlow et al. | 254/423 |
| 3,582,043 | 6/1971 | Tranchero | 254/2 R |
| 3,740,020 | 6/1973 | Arnes | 254/2 B |

*Primary Examiner*—Robert C. Watson

*Attorney, Agent, or Firm*—Douglas M. Clarkson

[57] ABSTRACT

The disclosure describes an air jack with features that permit a substantial increase in performance during operation. A load engaging bracket includes a telescoping connection with rollers so that the connection will extend readily under loaded conditions without the air jack being subjected to forces that would tend to tilt it or otherwise move it. The ground-engaging member has sides that are positioned apart to define a dimension greater than the fully retracted load-engaging bracket to permit the bracket to lower between the sides thereby defining a minimum down height. An air manifold is positioned to furnish air under pressure not only for operating the air jack but for operating a number of air tools that are associated with the need for the air jack. The air jack has pockets to hold these tools when they are not being operated.

15 Claims, 2 Drawing Figures

HIGH PERFORMANCE AIR JACK

FIELD OF THE INVENTION

The present invention, generally, relates to pneumatically operated lifting devices and, more particularly, to air jacks of the type used primarily in vehicle service stations, garages, repair shops, race tracks and anywhere that a vehicle would be serviced.

BACKGROUND OF THE INVENTION

Air is used as the operating medium, instead of hydraulic fluid such as oil, in those situations calling for fast operation coupled with reliability because air, under pressure, does not take a lot of time metering through an opening. It is readily available, inexpensive and reacts reliably under pressure.

However, it has been many years since any significant advance has been made in the overall structure of a device known as the "air jack". Yet, as the economy continues its steady advance, many of the smaller business operations have been forced to close because they cannot keep pace in the continuing costreduction activities needed to be profitable.

A service team at an auto raceway is an example of a need for a device to lift one side of a car quickly and safely while tires are checked and changed and to service the under side of the car. If many smaller service stations and garages could learn to compete the way these race track service teams work, profits would be increased because less time would be needed to service each car.

OBJECTS AND SUMMARY OF THE INVENTION

It is a primary object of the present invention to provide a new and improved air jack with a structure that admits of a substantial improvement in overall performance.

Another object of the invention is to provide a lifting device of the air jack type that is capable of being operable with the lowest vehicle in use today while still providing an increase in operating performance.

Still another object of the invention is to provide an air jack structure that permits a substantial increase in its operating performance while maintaining a high degree of safety.

Briefly, an air jack constructed in accordance with the present invention has an axle with wheels and a vertical member extending from the axle and terminating in a piston. A cylinder with a closed upper end and an open lower end is disposed over the piston to support a load-bearing bracket.

The cylinder also has means to detachably affix an air supply hose for receiving a source of air under pressure for use by, for example, the cylinder during its operation. In addition, the load-bearing bracket has a load-engaging member and a telescoping connection between the bracket and the load-engaging member which defines a predetermined distance when it is retracted fully. An elongated member engages the ground to stabilize the air jack and includes side elements that are affixed to the axle and extend therefrom in a flared apart relationship to define a distance at least as great as the predetermined distance of the fully retracted telescoping connection between the load-bearing bracket and the load-engaging member.

The above and other objects and advantages of the present invention will become more readily apparent from the following detailed description of the presently preferred embodiment and from the appended drawings.

THE DRAWINGS

In the accompanying drawings, the same reference numerals are used to identify the same or similar component parts, and:

FIG. 1 is a view in perspective of an air jack constructed in accordance with the invention in its raised condition; and FIG. 2 is a view similar to FIG. 1 showing some of the operative component parts in an exploded view to aid in the detailed description to follow.

DETAILED DESCRIPTION

Figure 1:
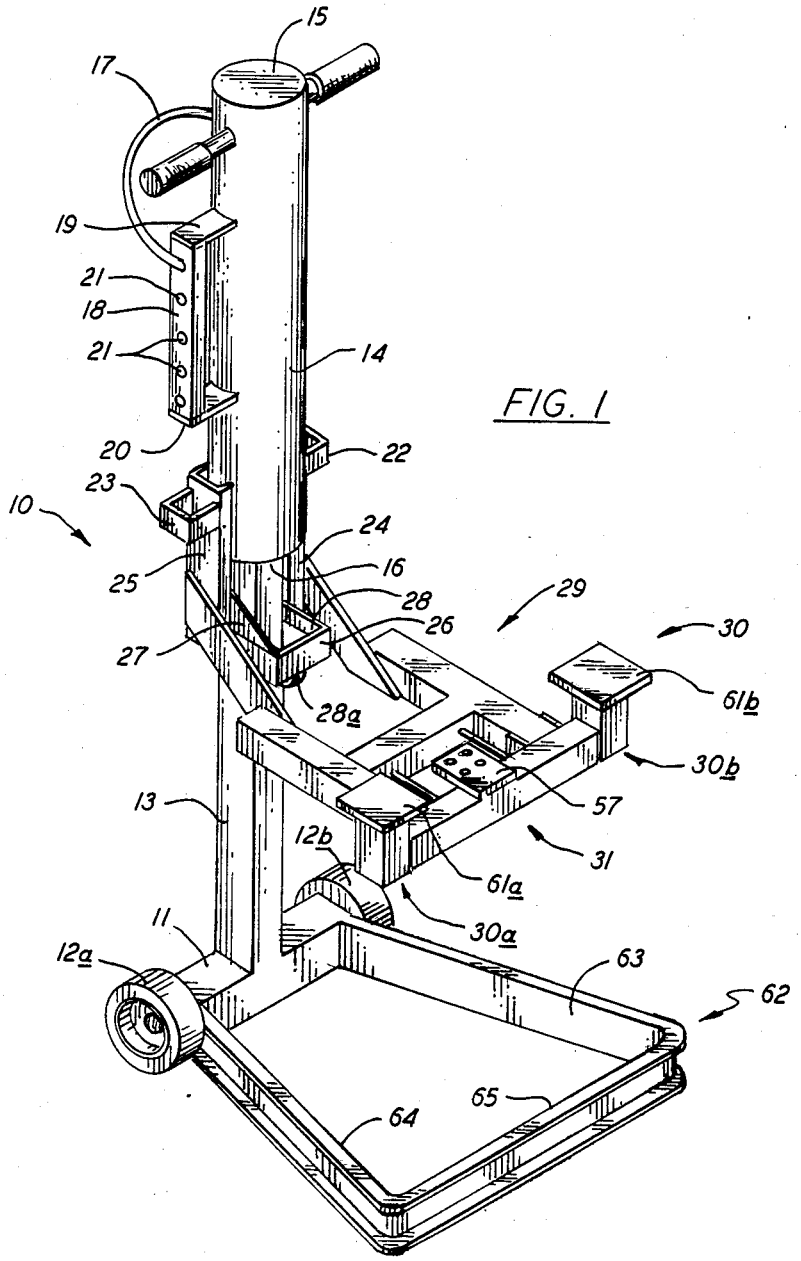

Referring now to FIG. 1 of the drawings, the air jack of the present invention is identified generally by the reference numeral 10, which also shows the air jack in its fully raised or fully extended or its highest operating position. Of course, the air jack 10 has a safety catch or lock, but that feature is not shown in the drawings or identified by a reference numeral because its structure is not a part of the present invention.

An axle 11 is formed of any suitable length and of any suitable material, depending of course on the weight to be lifted by the air jack 10. One factor to be taken into consideration in determining the length of the axle 11 is the overall height of the air jack 10 when it is raised fully. The length of the axle 11 has a relationship to the lateral stability of the air jack 10, Affixed rotatably on each end of the axle 11 are wheels 12*a* and 12*b*. These also are not a part of the present invention because various manufacturers have their own ideas as to the shape and other characteristics of the wheels. Their primary function is to permit greater ease in moving the air jack 10 about from one location to another.

While the shape of the axle 11 may be any shape desired from round to -whatever-, the presently preferred shape is square, because a vertical member 13 is welded to the axle 11. The vertical member 13, also, should be relatively strong because it must support the weight to be lifted without flexing, twisting or bending.

Affixed to the upper end of the vertical member 13 is a piston (not shown) that, preferrably, is round. The structure of the piston is not illustrated because it forms no part of the invention, and besides, most jacks, hydraulic and air, use round pistons. Their structural requirements are well known in the art, i.e., they must form a fluid-tight seal and, for that reason, usually have a sealant, such as an O-ring, also well known in the art.

A cylinder 14 is positioned vertically over the vertical member 13 so that the piston forms a fluid-tight seal inside the cylinder 14. The cylinder 14 is closed at its upper end 15 and is open at its lower end 16.

The fluid-tight (or air-tight) seal formed by the piston within the cylinder 14 creates an air-tight chamber within the cylinder 14 between the piston and the upper end 15, so that air under pressure within the chamber will cause the cylinder 14 to rise (go upwardly) as viewed in FIG. 1. An air hose 17 furnishes air to the inside of the cylinder 14 and is attached to the cylinder 14 near the closed upper end 15, which comes the closest to the piston when the cylinder 14 is retracted to its fully down position.

Air under pressure is supplied to the hose 17 from an air manifold 18 which, according to one aspect of the invention, is generally rectangular in cross-section with its upper end sealed by a member 19 welded thereto and the lower end sealed in like manner by a member 20. The members 19 and 20 are sufficiently long to support the manifold 18 spaced slightly from the cylinder 14, as illustrated in the drawings.

The manifold 18 is formed with a plurality of threaded holes 21, one end of the air hose 17 being shown affixed to the uppermost hole 21. Any one of the other threaded holes 21 can be used to attach an air supply hose (not illustrated). An air supply hose can be in any desired form, such as is available in most garages, service stations and anywhere cars are expected to be serviced.

One example of another area where cars are expected to be serviced is at an auto raceway. There at such a raceway cars must be serviced quickly and efficiently, and it is not uncommon for raceway service crews to practice for hours to achieve a maximum of efficiency in the servicing of a car in a minimum of time. Such service usually includes changing tires.

Therefore, having an air supply easily available without so many hoses around to impede the movement of people and other equipment on wheels will contribute to performance. Two of the three additional holes 21 are available, according to anther aspect of the invention, for attaching hoses for two air-operated tools, such as air wrenches. If a third air tool is not needed, the hole can be plugged easily.

For a racing car, the extra tires are already mounted on rims or wheel so that to change tires, on wheel is removed and a wheel with a new tire already mounted is installed on the car. Usually, this requires removing five nuts to remove a wheel and replacing five nuts to secure a new wheel.

With the high performance air jack of the invention, having two air tools readily available is an important feature, and to support the two air tools, there are two pockets 22 and 23, one on each side of the cylinder 14 at its lower end. To minimize the amount of welding on the cylinder 14, and the accompanying risk of weakening the cylinder, the pockets are welded to channel sections 24 and 25, respectively.

Each of the channel sections 24 and 25 is welded firmly and securely to the outside of the cylinder 14 with approximately one-half their length extending below the open end 16. Welded to each of the channel sections 24 and 25 is a U-shaped part 26 which obtains additional support and strength from two gussets 27 and 28. The part 26 carries a roller 29 which rides against the vertical member 13 and forms an equal and off-setting moment (a Moment=a Force×a Lever Arm) to maintain the cylinder 14 operating smoothly under a fully loaded condition, as will be explained in more detail presently.

A load-bearing bracket 29 has a load-engaging member 30 that has two parts 30*a* and 30*b*, and there is a telescoping connection 31 joining the two in a particular way that will be described in more detail presently.

THE LOAD-BEARING BRACKET

Figure 2:
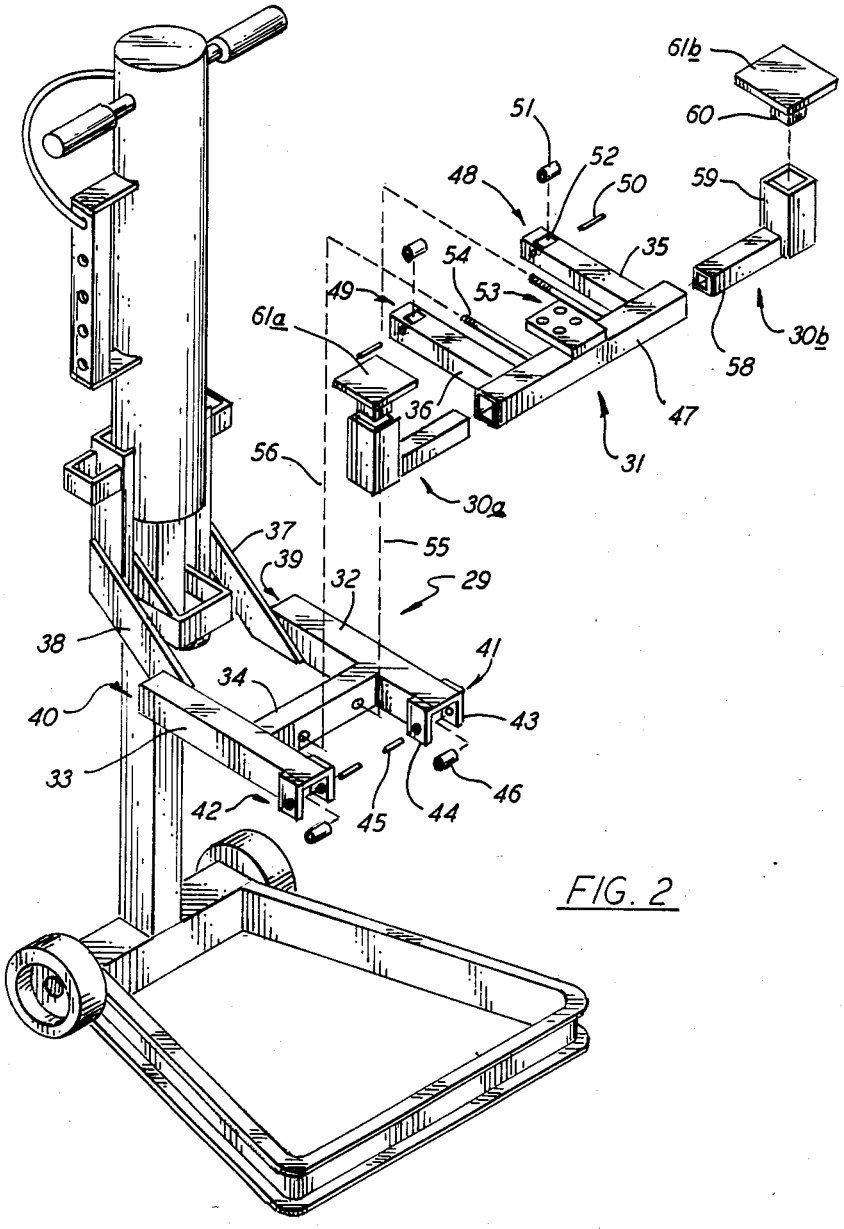

In FIG. 2 of the drawings the load-bearing bracket 29 is seen separated from its surrounding structure more clearly. It is formed in a generally H section, with two side arms 32 and 33 joined by a cross arm 34. Each of the arms 32, 33 and 34 are formed of tubular sections for several important reasons, two of which are (1) to provide a maximum of strength with a minimum of weight because these arms 32, 33 and 34 are positioned generally in a horizontal location to support the entire load of the air jack. They cannot bend, twist or flex but must be in a constantly rigid position.

A second reason for the tubular sections 32, 33 and 34 is (2) the side arms 32 and 33 receive sections 35 and 36, FIG. 2, in a close-fitting, sliding, telescoping relationship. This is a most important feature and permits the full realization of the high performance in the air jack of the invention. But first, to complete the description of the load-bearing bracket 29, the bracket is attached to and supported by the cylinder 14.

Two support plates 37 and 38 have one end welded to the lowermost ends of the respective channel sections 24 and 25 so that the elongated plates 37 and 38 extend at approximately 45° downwardly and away from the vertical member 13. The lowermost ends of each respective elongated support plate 37 and 38 is welded to the inside surface of each of the side arms 32 and 33 adjacent the ends 39 and 40, FIG. 2.

The opposite end 41 of the side arm 32 from the end 39 is re-enforced with gussets 43 and 44 with holes to receive a pin 45 which forms an axle for a roller 46. The gussets 43 and 44 support the pin 45 so that the uppermost point on the surface of the roller 46 is slightly higher than the inside lower surface within the side arm 32. The end 42 of the side arm 33 is of a similar construction to that just described for the end 41.

THE TELESCOPING CONNECTION

As best seen in FIG. 2, the two sections 35 and 36 are joined by another section 47 in a generally "pi" configuration. The ends 48 and 49 of the two sections 35 and 36 that are furthermost from the section 47 are formed each similar to the other.

For example, the end 48 has a hole near the upper surface of the section 35 to receive a pin 50 which forms an axle for a roller 51. An opening 52 in the upper surface of the section 35 permits the pin 50 to support the roller 51 so that the uppermost point on the surface of the roller 51 extends through the opening 52 so that it is only slightly higher than the upper surface of the section 35. The end 49 of the section 36 is of a similar construction to that just described for the end 48.

Now, the end 48 of the section 35 will fit within the end 41 of the side arm 32 in a close-fitting, sliding, telescoping relationship, with the roller 51 in rolling engagement with the inside, uppermost surface of the tubular side arm 32 and with the roller 46 in rolling engagement with the outside, lowermost surface of the section 35. The section 36 will fit within the end 42 of the side arm 33 in a similar manner to form a very effective telescoping connection.

With the two sections fitted within the respective side arms 32 an 33 in a telescoping relationship, there are two rods 53 and 54 which are welded to the section 47 to extend through matching holes in the cross arm 34, as indicated by broken lines 55 and 56, respectively, in FIG. 2. The ends of each rod 53 and 54 that are furtherest from the section 47 are threaded to receive locknuts (not seen) on the far side of the cross arm 34.

With a structure as described above, the sections 35 and 36 are prevented from being separated from the side arms 32 and 33 and, when in this prevented position, the telescoping connection will be in its fully extended condition. Therefore, the two rods provide a safety feature for the high performance air jack of the present invention.

The telescoping connection 31 will appear as illustrated in FIG. 1 of the drawings when it is in its fully retracted condition. In this view, a plate 57 is illustrated as welded securely to the upper surface of the section 47 to support a caster (not visible) to engage the ground and, along with the wheels 12*a* and 12*b*, provide a rolling engagement with the ground by lifting all other ground-engaging structure from the ground, as will be described in more detail presently.

THE LOAD-ENGAGING MEMBER

Like the tubular arms 32, 33 and 34, the sections 35, 36 and 47 are formed of tubular parts also, and the tubular section 47 is the joining part between the telescoping connection 31 and the load-engaging member 30, as will now be described in detail.

As better seen in FIG. 2 of the drawings, only the part 30*b* will be described in detail now because the part 30*a* is of like construction.

The load-engaging part 30*b*, basically, is formed of two separate elements: 58 and 59; 60 and 61*b*. The element 58 and 59 is reversible, which is important in adjusting the fixed down-height of the air jack. The element 58 and 59 is formed of two projections, a projection 58 being of a cross-sectional dimension to match the inside of the tubular section 47 so that the projection 58 fits in close-fitting, sliding relationship.

The length of the projection 58 can be any desired but no longer than one-half the length of the section 47. In this way, a minimum dimension is achieved when the load-engaging member is retracted fully.

A projection 59 is welded to the end of the projection 58 that is furthermost from the end that engages the section 47, but the projection 59 is attached in a particular way. As viewed in FIG. 2, one end of the projection 59 is flush with the lower surface of the projection 58, while the opposite end is substantially higher than the upper surface of the projection 58.

A shorter projection 60 matches the inside dimension of the projection 59 to fit in sliding engagement with either end of the projection 59. Therefore, if a different down-height is needed, the element 58 and 59 is removed from the section 47, it then is inverted and the projection 58 is reinserted into the end of the section 47.

A load-engaging pad 61*b* is fixedly attached to the upper end of the shorter projection 60, as viewed in FIG. 2. Both of the pads 61*a* and 61*b* are of any desired construction.

One of the important aspects of an air jack that is constructed in accordance with the present invention is the ability of the air jack to be operable in any given situation. One situation involves a need to obtain the lowest possible down-height.

An example of such a situation is when a racing car has two flat tires on the same side of the car. With a car sitting on the rims on one side, an air jack of the invention would fit readily under the side of such a car because of a unique feature that will now be described.

The outside surface of the vertical projection 59 (the surface that is furthermost from the same surface on the same part of the part 30*a*) and the outside surface of the corresponding projection of the part 30*a* when the load-engaging member 30 is in its fully retracted condition, as in FIG. 1, defines a very important dimension. For the purposes of this description, it shall be called a "predetermined dimension".

Affixed securely, as by welding, to the axle 11 are the ends of an elongated ground-engaging, jack-stabilizing member 62. The member 62 has side elements 63 and 64 that extend from the axle 11 in a flared apart relationship in order to define a distance that is at least as great as the above-identified "predetermined dimension".

While the side elements 63 and 64 are described as being flared apart, they could as easily be parallel, or even extend inwardly and toward each other by adjusting the length of the axle 11. In other words, if the axle 11 is longer than that shown in the drawings, the side elements 63 and 64 could extend parallel to each other, the important feature being that the side elements 63 and 64 define a distance between them that is at least as long as the defined "predetermined dimension".

By this structure, the air jack of the present invention will achieve a lower down-height than any air jack heretofore known by the load-bearing bracket being constructed to fit down inside (or between) the side elements of the ground-engaging member 62. An end 65 forms a continuation of the side elements 63 and 64, the entire ground-engaging, jack-stabilizing member 62 being formed, preferably, of a suitable channel configuration.

In operation of the air jack of the invention, the air jack 10 is moved in its fully down position rolling on the wheels 12*a* and 12*b* and the caster supported by the plate 57. The air jack 10 can be moved readily to any position beside a load to be raised, for example to one side of an automobile.

With the load-engaging pads 61*a* and 61*b* adjusted to contact the car in a manner desired, as any auto mechanic knows, air under pressure is supplied through the manifold 18 and the air hose 17 to the upper end of the cylinder 14, causing the cylinder 14 to raise upwardly. A car being raised on one side will pivot about the two wheels on the opposite side, and in so pivoting, the car will move away from a straight vertical line over the air jack 10.

However, the telescoping connection 31 readily moves outwardly also maintaining its support of the automobile. As the cylinder 14 moves upwardly under a load, another force is applied tending to move the bottom, open end 16 of the cylinder 14 toward the vertical member 13. However, the roller 29 rides against the vertical member 13 to maintain an offsetting force and to continue smooth operation of the cylinder 14.

As described previously, having a supply of air under pressure readily available by means of the manifold 18 will contribute as a real plus in achieving the high performance that an air jack 10 of the invention provides. Actually, to achieve the absolute highest in performance, all of the features of the air jack 10 of the present invention co-act together in a positive way contributing to the fast, efficient operation as a structure in accordance with the invention will provide.

In view of the hereinabove detailed description of the presently preferred form of the invention, various modifications will occur to one skilled in this art. However, it is to be undertood that all such modifications come within the spirit of the invention, the invention being defined only by the claims appended thereto.

I claim:

1. A high performance air jack, comprising:

an axle having a predetermined length and including wheel means mounted rotatably at each end of said predetermined length;

a vertical member extending from said axle and terminating in a piston member;

cylinder means having a closed upper end and an open lower end is disposed moveably in air-sealing relationship with said piston member;

means to detachably affix an air suppy hose to said cylinder means for receiving a source of air under pressure;

a load-bearing bracket having two tubular arms attached one arm to each side of said cylinder means with three tubular sections in a generally pi configuration, two of said sections fitting in a telescoping relationship with said tubular arms with the third of said three sections affixed to said two telescoping sections with two load-engaging members to define a predetermined distance when fully retracted; and elongated ground-engaging, jack-stabilizing means with side elements affixed to said axle and extending therefrom in a spaced apart relationship to define a distance at least as great as said predetermined distance.

2. A high performance air jack as defined in claim 1 wherein said means to detachably affix an air supply hose includes air manifold means supported by said cylinder means and including means to define an opening from said air manifold means to the inside of said cylinder means between said closed upper end and said piston member.

3. A high performance air jack as defined in claim 2 wherein said means to define an opening from said air manifold means to the inside of said cylinder means includes a flexible hose.

4. A high performance air jack as defined in claim 1 wherein said load-bearing bracket includes means to support a plurality of air-operated tools.

5. A high performance air jack, comprising:

an axle having a predetermined length and including wheel means mounted rotatably at each end of said predetermined length;

a vertical member extending from said axle and terminating in a piston member;

cylinder means having a closed upper end and an open lower end is disposed moveably in air-sealing relationship with said piston member;

means to detachably affix an air supply hose to said cylinder means for receiving a source of air under pressure;

a load-bearing bracket attached to said cylinder means with a load-bearing member and a telescoping connection between said bracket and said load-engaging member which defines a predetermined distance when fully retracted;

elongated ground-engaging, jack-stabilizing means with side elements affixed to said axle and extending therefrom in a flared apart relationship to define a distance at least as great as said predetermined distance; and said load-bearing bracket includes means to support a plurality of air-operated tools, including pocket means affixed to said load-bearing bracket to support at least one air-operated tool.

6. A high performance air jack as defined in claim 5 wherein said pocket means includes at least two pockets affixed to said load-bearing bracket in predetermined spaced apart positions.

7. A high performance air jack as defined in claim 6 wherein said load-bearing bracket is attached to said cylinder means in a spaced apart relationship to be positioned below said open lower end to fit between said side elements of said elongated means.

8. A high performance air jack as defined in claim 1 wherein said telescoping arms and sections include safety means to limit the withdrawal of the telescoping parts.

9. A high performance air jack as defined in claim 1 wherein said load-engaging members include reversible means to lower the down height of said air jack.

10. A high performance air jack as defined in claim 9 wherein said load-engaging members include removeable load-engaging pads.

11. A high performance air jack, comprising:

means to define an axle of predetermined length including rotatable means supported thereby;

vertical means extending from said means to define an axle to support piston means;

cylinder means having a closed upper end and an open lower end disposed moveably over said piston means;

air manifold means including means to define a plurality of holes to attached air hoses and means to communicate air under pressure within said air manifold means to said cylinder means above said piston means; and load-engaging means including means to engage a load to be raised and telescoping means to support said means to engage a load from said cylinder means; said telescoping means comprising:

three tubular members formed in a generally H configuration, with two members supported from said cylinder means and a third member affixed between the two members; and three tubular sections formed in a generally pi configuration, two of said sections fitting in a telescoping relationship with said two members and the third section affixed to said two telescoping sections.

12. A high performance air jack as defined in claim 11 including load-bearing plate means attached to extend below said open end of said cylinder means to permit said load-engaging means to be lowered to a minimum down height.

13. A high performance air jack as defined in claim 11 including load-bearing plate means supported by said cylinder means in a predetermined position, said position being approximately 45 degrees downwardly and away from said vertical means.

14. A high performance air jack as defined in claim 11 including means on said load-engaging means to define a predetermined dimension when fully retracted, and elongated ground-engaging means with said elements extending from said means to define an axle in a predetermined manner to define a distance greater than said predetermined dimension, so that said air jack will define a minimum of down height when lowered.

15. A high performance air jack as defined in claim 11 wherein said tubular members and said two tubular sections include roller means to permit relative movement with a minimum of friction when said load-bearing bracket means supports a load while said air jack is being operated and said cylinder means is being raised and lowered.

* * * * *